United States Patent [19]

Menard

[11] 4,319,430

[45] Mar. 16, 1982

[54] SLIDING CLOSURE ASSEMBLY

[75] Inventor: Jacques Menard, Laval, Canada

[73] Assignee: Preciform Inc., Laval, Canada

[21] Appl. No.: 153,966

[22] Filed: May 28, 1980

[51] Int. Cl.[3] ..... E05D 15/06; E06B 1/04

[52] U.S. Cl. ..... 49/404; 49/406; 49/457; 52/207; 160/91

[58] Field of Search ..... 49/404, 406, 428, 458, 49/459; 52/207; 160/90, 91

[56] References Cited

U.S. PATENT DOCUMENTS

| | | | |
|---|---|---|---|
| 2,918,708 | 12/1959 | Sharp et al. | 160/91 X |
| 3,097,401 | 7/1963 | Riegelman | 52/207 X |
| 3,136,396 | 6/1964 | Sullivan | 160/91 X |
| 3,295,587 | 1/1967 | Horgan, Jr. | 160/91 |
| 3,315,414 | 4/1967 | Nolan et al. | 160/91 X |
| 3,324,597 | 6/1967 | Rich | 52/207 X |
| 3,344,575 | 10/1967 | Grossman | 52/207 X |
| 4,151,682 | 5/1979 | Schmidt | 49/404 |

*Primary Examiner*—Philip C. Kannan

*Attorney, Agent, or Firm*—Diller, Ramik & Wight

[57] ABSTRACT

A patio door assembly made up of two identical glazed panels with one panel slidable in a frame and the other panel fixed to one of the respective jambs of the frame. The fixed panel is mounted on a false rail on the sill of the frame while a false mullion member and a sash block are provided which are easily removable to allow the fixed panel to be fixed to the other jamb of the frame. The sash block has a reversible insert which makes it conform to either position of the fixed glazed panel.

5 Claims, 8 Drawing Figures

SLIDING CLOSURE ASSEMBLY

BACKGROUND OF THE INVENTION

1. Field of the Invention

The present invention relates to a sliding panel assembly, and more particularly, to a sliding glazed door assembly comprising a fixed glazed panel and slidable glazed panel movable in a plane parallel and adjacent the fixed panel.

2. Description of the Prior Art

There exist today numerous examples of so-called patio door assemblies which include a prefabricated assembly comprising a frame made of wood or aluminum and two glazed panels within the confines of the frame. One of the glazed panels is fixed while the other slides on a rail provided on the sill. When the door assembly is closed, there should be proper weather-sealing between the panels. The problem which has been encountered in the sale and distribution of the door assemblies is that considerable inventory must be maintained in such assemblies for situations because a panel must be fixed either to the left of the frame or to the right of the frame. Furthermore, once a patio door has been installed, it is no longer possible to change the position of the fixed panel.

SUMMARY OF THE INVENTION

It is an aim of the present invention to provide a sliding panel assembly comprising a fixed panel and a movable panel, wherein the fixed panel may be readily changed from one side of the frame to the other.

A construction in accordance with the present invention includes a sliding panel assembly comprising a frame having a pair of jambs, a lintel and a sill with the sill including a sloped drainable surface, a first panel receiving rail extending longitudinally of the sill, at least a first and second panel being interchangeable and each having a bottom and an upper sash with the bottom sash being adapted to slide on said rail, said first panel being mounted on said rail for sliding movement, the second panel being mounted parallel and adjacent the first panel but in fixed relation thereto with one of the vertical sashes of the second panel in weather-sealing engagement with one of the jambs of said frame, said second panel being mounted on the down slope side relative to said first panel, a removable false rail provided on the sill and seating the lower horizontal sash of the second panel, a mullion member comprising weather-stripping being removably mounted to the other sash of said second member, said mullion member adapted to act as a weather-seal between adjacent vertical sashes of the panels when the panels are in a closed position, and a sash block removably mounted to the sill and located below the other sash of the second panel, the sash block having a wedge-shaped portion extending towards the rail and corresponding to the slope of the sill, and upwardly extending projections adapted to extend the false rail and to cooperate with the mullion member to complete the weather-seal between the respective adjacent sashes of the first and second panels and the sill, whereby the mullion and sash block members can be adapted to the one sash if the panel is to be fixed to the other side of the frame with the other sash weather-sealingly engaging the other vertical jamb.

BRIEF DESCRIPTION OF THE DRAWINGS

Having thus generally described the nature of the invention, reference will now be made to the accompanying drawings, showing by way of illustration, a preferred embodiment thereof, and in which.

DESCRIPTION OF THE PREFERRED EMBODIMENTS

Figure 1:
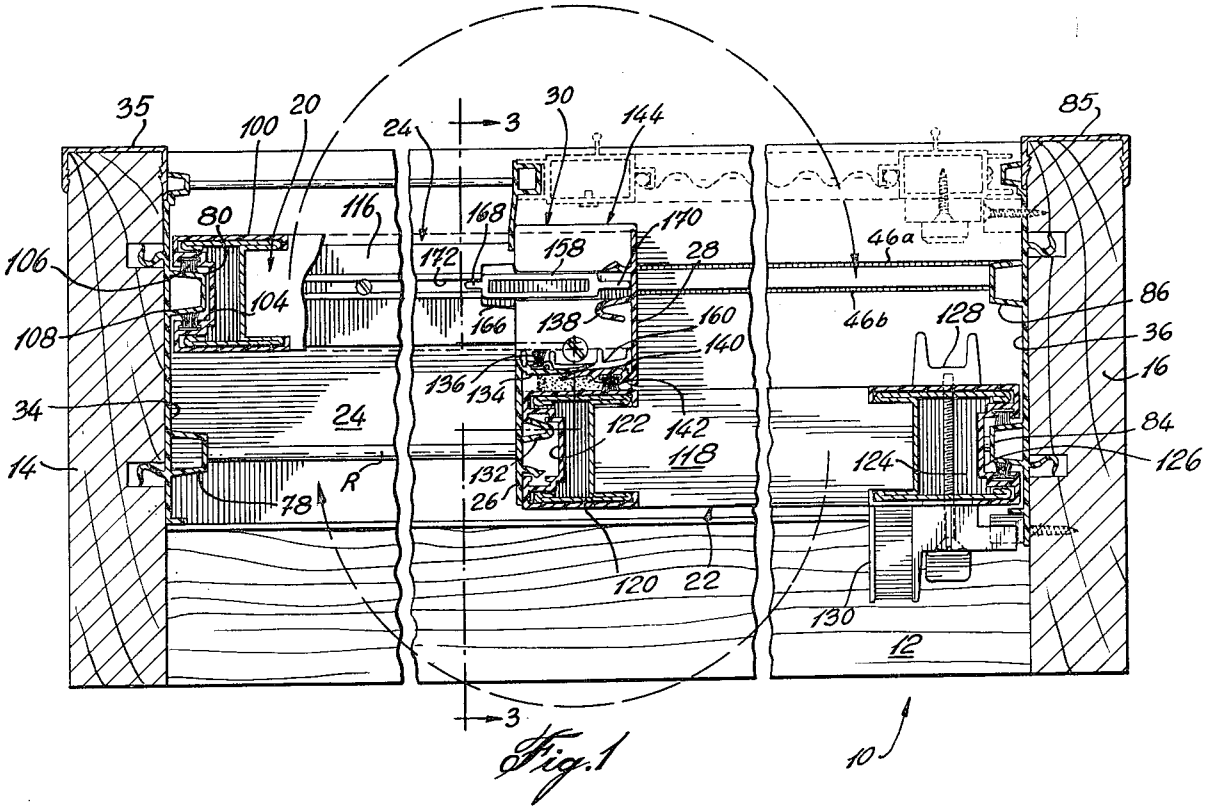
FIG. 1 is a horizontal cross-section looking down on a sliding patio door closure having two panels with the left panel fixed and the right panel sliding.
Figure 3:
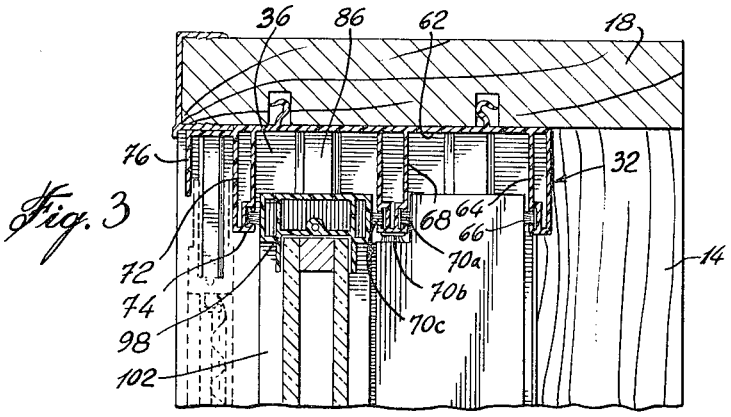
FIG. 3 is a vertical cross-section taken along line 3—3 of FIG. 1.

Referring now to the drawings, and particularly to FIGS. 1 and 3, there is shown a frame 10 of a preassembled closure adapted to be fitted in an aperture of a building. The closure is in the form of a sliding door assembly wherein the door panels are glazed panes. The assembly may be referred to as a patio door assembly. It is customary in such assemblies to fix one of the panels to the frame and allow the other panel to slide. Access into and out of the building is possible through the open side of the closure when the sliding panel has been pushed back from its closed position.

The frame 10 includes a sill 12, side jambs 14 and 16, and a lintel 18. Glazed panel 20 is mounted in a fixed manner within the frame against the jamb 14. A sliding glazed panel 22 is provided for movement on a rail R on the sill 12. The rail R forms part of a fabricated rail assembly 24. The glazed panels 20 and 22 mount false mullion members 26 and 28 respectively for providing a weather-seal between the adjacent glazed panels 20 and 22 when the panels are in a closed position. The fixed panel 20 is similar in construction to the panel 22 and is adapted to be fixed either to the left or to the right-hand jamb 14 and 16 respectively. The false mullion 28 is, of course, easily removed for replacement on the other side of the panel 20, while a sash block 30 is provided underneath the glazed panel 20 as will be described further.

The jambs 14 and 16 are provided with jamb plates 34 and 36 respectively which, in this case, are made of extruded thermoplastic material. Most of the extruded parts making up the window construction are of similar thermoplastic material for better wear and insulating characteristics.

As shown in FIG. 3, the lintel 18 is provided with a rail assembly 32 as will be described further.

The sill 12 mounts the rail assembly 24 which is best shown in FIG. 3. The first section 38 is an extruded aluminum part having a facing 40, a screen rail 42, and support legs 44 and 45. Shallow grooves **46*a* and 46*b* are provided longitudinally of the first metal section 38**. A thermal break in the form of a second extruded section 50 of thermoplastic material is provided interlocked with the first section 38. The section 50 includes an upstanding flange 52 forming part of the rail R. A third section 54 is provided having a flange 56 which, along with flange 52, forms the rail R. The third section 54 includes support legs 58 and 60. The rail section 24 is fixed to the sill 12 by means of conventional wood screws or the like.

The rail assembly 32 of the lintel 18 is also illustrated in FIG. 3 and includes three box-shaped guides 64, 68 and 72. These guides 64, 68 and 72 form therebetween tracks for the top sashes of the panels 22 and 20, such as sash 98 of panel 20. Guides 64 and 68 mount opposed weather-strips 66 and 70*a* respectively while the guide 68 also mounts weather-strips 70*b* and 70*c*. Guide 72 mounts a weather-strip 74 facing the weather-strip 70*c*. These weather strips will be in contact with the upper sashes of the panels 20 and 22. The guides are mounted or are formed as an extruded member with the lintel plate 62 and also include a flange 76 which acts as a guide for the screen panels shown in dotted lines.

Figure 2:
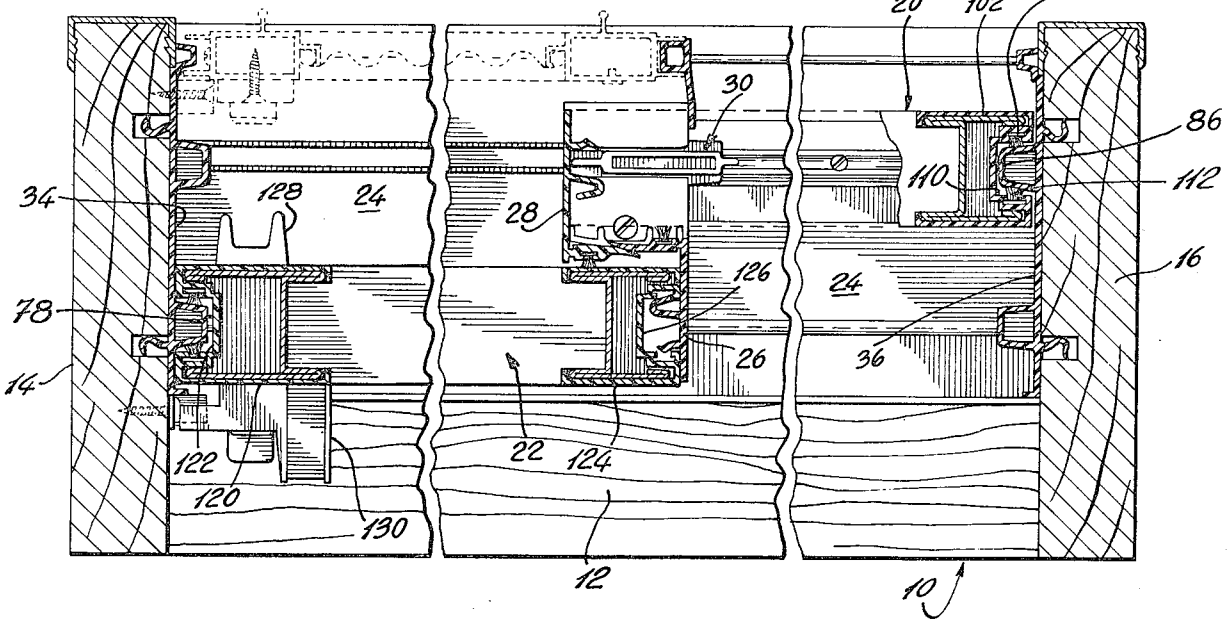
FIG. 2 is a horizontal cross-section similar to FIG. 1 but showing the fixed panel on the right-hand side.

Referring now to FIGS. 1 and 2, the jamb 14 mounts a jamb plate 34 having rails 78 and 80. The guide plate 34 with the rails 78 and 80 are also made of extruded thermoplastic sections. The plate 34 may extend into a flange facing member 35 as shown. The jamb plate 34 is identical to the jamb plate 36 mounted to the jamb 16 and which includes rails 84 and 86. A facing section 85 may also be provided.

Referring now to FIGS. 1, 2 and 3, panel 20 is illustrated as having panes 90 mounted in a bottom sash 92. Bottom sash 92 includes a longitudinal groove 94 facing downwardly. Weather-strips 96*a* and 96*b* are provided in the groove 94 to engage the rail or, in this case, the false rail 116, as will be described. The panel also includes a top sash 98 and side sashes 100 and 102. Side sash 100 includes a groove 104 which in this case mates with the rail 80. The groove 104 also includes weather-strips 106 and 108. The sash 102, as shown in FIG. 2, includes a groove 110 with respective weather-strips 112 and 114, and these are adapted to mate with the rail 86, as shown in FIG. 2, when the panel 20 is in its alternate fixed position.

Glazed panel 22, which is identical to the glazed panel 20, is in this case the sliding panel and includes a bottom sash 118 and side sashes 120 and 124. Side sash 120 has a groove 122 adapted to engage rail 78. Side sash 124 has a groove 126 adapted to engage the rail 84 on the jamb 16. The bottom sash 118 of the panel 22 is not shown in these drawings but is identical in construction to sash 92 and has a groove which rides on the rail R. The ash 120 in FIG. 3 is covered by the false mullion 26 and only the slot in the false mullion 26 is shown although it is in alignment with the groove of the bottom sash 118.

A handle 128 and lock handle 130 are provided on the sash 124 of panel 22 in the situation illustrated in FIG. 1, while in FIG. 2, the handle 128 and lock handle 130 are provided on the sash 120 of panel 22.

Figure 7:
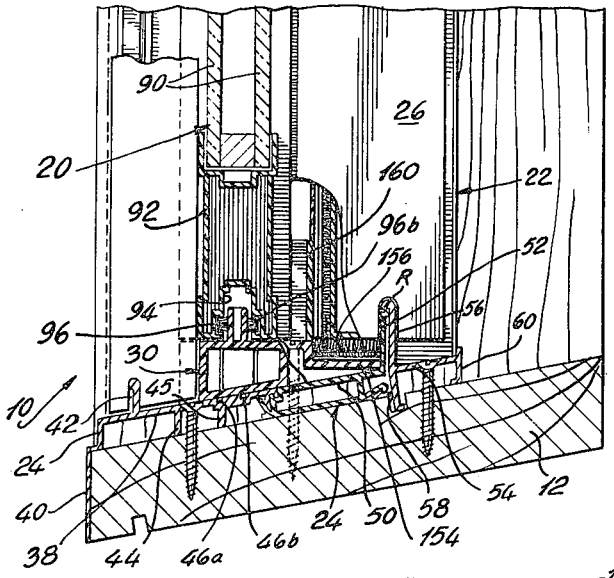
FIG. 7 is a top plan view of the detail shown in FIG. 5 with a portion thereof in a different operable position.
Figure 7:
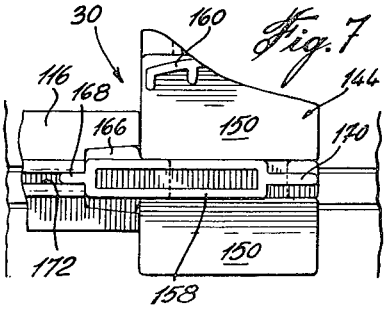
Figure 8:
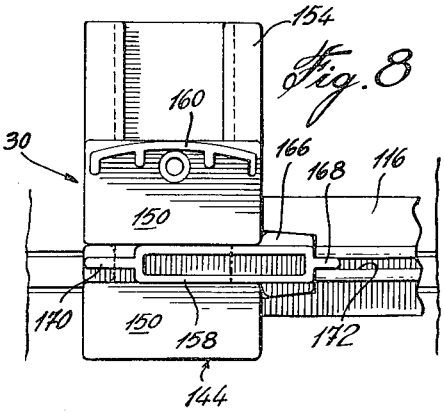
FIG. 8 is a top plan view of the detail shown in FIG. 5.
Figure 5:
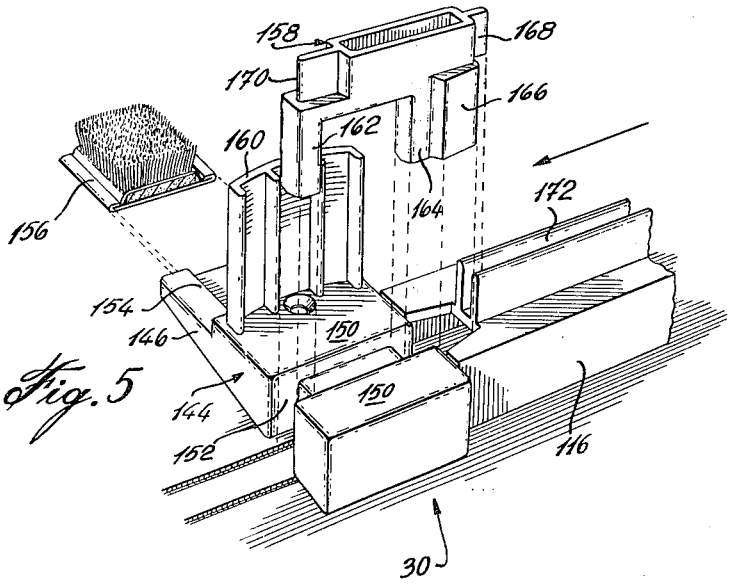
FIG. 5 is a perspective view of a detail of the present invention partly exploded.
Figure 6:
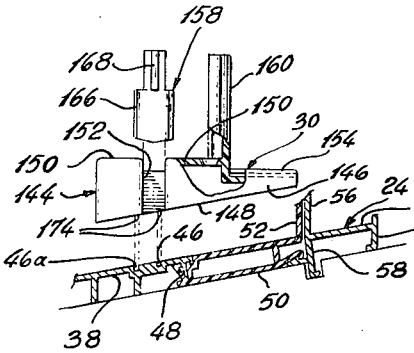
FIG. 6 is an end elevation of the detail shown in FIG. 5 in the direction of the arrow x.
Figure 4:
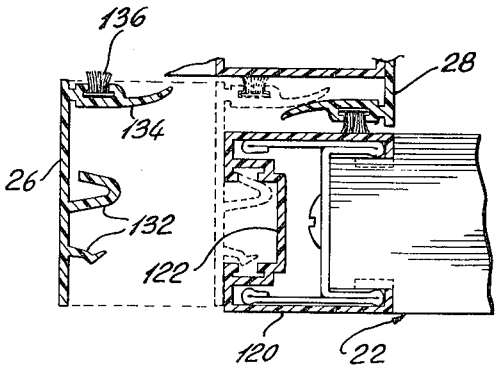
FIG. 4 is an enlarged fragmentary detail of FIG. 1 partly exploded.

The false mullion 26 includes, as shown in FIG. 4, clip devices 132 and a flexible curved flange 134 mounting a weather strip 136. A similar false mullion 28 is provided on sash 102 of glazed panel 20, as shown in FIG. 1, to mate and create a weather-seal with the false mullion 26 when the panels 20 and 22 are closed. The glazed panels 20 and 22 are identical and interchangeable; however, the sill 12 has a sloped surface to allow for proper drainage towards the exterior of the closure. Thus, it is necessary to provide a false rail 116 underneath the glazed panel 20 and fixed to the rail assembly 32. When it is necessary to move the glazed panel 20 from one side to the other of the opening, the false rail 116 must be removed and placed on the side of jamb 16, as shown in FIG. 2. The false rail 116 does not extend below the sash 102 as shown in FIG. 1, and thus a separate sash block 30 is provided to create the necessary weather-seal at the critical portion of the mullion structure. The sash block 30 is interchangeable and can be used when the glazed panel 20 is in the position of FIG. 1 or in the position of FIG. 2. The sash block 30 is adapted to mate with the end of the false rail 116 as well as the sash 102 and the false mullion 28. The block 30 has a base 144 with a tapered section 146 having a sloped bottom surface 148 and a relatively horizontal top surface 150 with a stepped section 154. The tapered section 146 including the stepped section 154 mounts a weather-strip pad 156 and extends below the sash 122 of the panel 22, as shown in FIG. 1. The end of the tapered portion 146 abuts against the rail R and thus creates a weather-seal underneath the sash 118 of the glazed panel 22 in addition to creating a seal underneath the panel 20 along with the false rail 116. The sash block 30 includes a waisted groove 152 which is adapted to receive a reversible insert 158. The reversible insert 158 includes legs 162 and 164 as well as an enlarged plug 166. The plug is adapted to engage the trapezoidal opening formed in the end of the false rail 116 while fins 168 are adapted to engage within the groove 172 formed on the false rail 116. Legs 162 and 164 are adapted to engage in the waisted groove 152 of the base 144 and maintain the insert 158 whether it be in the position shown in FIGS. 5 and 8 or the reversed position shown in FIG. 7. The position of the insert 158 is suitable in the case of the glazed panel 20 being in the fixed position shown in FIG. 1. When it is necessary to place the glazed panel 20 in a fixed position on the right-hand side of the frame as shown in FIG. 2, the insert 158 is simply reversed as shown in FIG. 7, while the false rail 116 is placed on the other side of the block 30. The fin 168 will now engage the groove 172 in the new position of the false rail 116. Accordingly, it can be seen from the above described structure that the identical fixed glazed panel 20 can easily be placed on one side of the frame or the other merely by interchanging the false mullions 26 and 28 on the respective sashes which are clip-fitted, and by reversing the insert 158 on the block 30. The insert 158, as can be seen from the above description and from the drawings, fills in the various voids in the end of the false rail 116 and the sash 102 or 100 and particularly the grooves 110 and 104 respectively.

The surface 150 of the block 30 includes an upstanding shield-like member 160. As shown in FIGS. 1 and 3, this member 160 extends between the surface 150 and the lower edge of the curved flange 134 in order to block off a possible opening formed there. In order to make the mullions reversible, the flange 134 must be cut from the bottom, and thus the member 160 is shaped somewhat like flange 134 to form a virtual extension thereof.

I claim:

1. A sliding panel assembly comprising a frame having a pair of jambs, a lintel and a sill, the sill having a sloped drainable surface, a panel receiving rail extending longitudinally of the sill, at least a first and second panel being interchangeable and each having a bottom and an upper sash, said first panel being mounted on said rail for sliding movement, the second panel being mounted parallel and adjacent the first panel but in a fixed relation to the frame with one of the vertical sashes of the second panel in weather-sealing engagement with one of the jambs of the frame; said second panel being mounted on the down slope side of the sill relative to the first panel, a removable false rail provided on the sill and seating the lower horizontal sash of the second panel, a mullion member comprising weather-stripping being removably mounted to the other vertical sash of the second member, said mullion member adapted to act as a weather-seal between adjacent vertical sashes of the panels when the panels are in a closed position, and a sash block removably mounted to the sill and located below the other sash of the second panel, the sash block having a wedge-shaped portion extending towards the rail and corresponding to the slope of the sill, and upwardly extending projections adapted to extend the false rail and to cooperate with the mullion member to complete the weather-seal between the respective adjacent sashes of the first and second panels and the sill, one of the upwardly extending projections being in the form of a reversible insert such that when the fixed panel is mounted to the other side of the frame with the other sash weather-sealingly engaging the other vertical jamb, the sash block and mullion can be adapted to the one sash of the panel.

2. A closure as defined in claim 1, wherein the panels are glazed panels forming a sliding door assembly.

3. A closure as defined in claim 1, wherein the bottom sash of each of the panels includes a longitudinal groove and the rail is an upstanding rib adapted to engage the groove of either panel, the false rail including an upstanding rib having an elongated slot longitudinally thereof, the rib having a form adapted to engage the groove in the bottom sash of the fixed window and the sash block being co-extensive with the bottom sash.

4. A closure as defined in claim 3, wherein the sash block includes a top flat horizontal surface and upstanding vertical side walls, a waisted band portion forming a recess from the top surface and the side surfaces, a reversible insert having legs adapted to fit tightly in the waisted recess portion of the side wall, the insert having upstanding projections, the projections extending from one side thereof adapted to engage and close voids formed in the false rail and the false mullion such as to form a weather-seal with the fixed panel.

5. A sash block for use with a fixed panel in a sliding panel closure, the sash block including a rigid member having a sloped surface adapted to correspond to the sloped drainage surface of a sill of a frame in which the sash block is to be mounted, and a horizontal top surface, the block also including opposed vertical side walls, a reversible insert including upward projections and side projections adapted to engage and seal voids in the bottom of the fixed panel, means on the fixed portion of the block for receiving the reversible insert, the reversible insert being adapted to engage the bottom of the fixed panel whether the panel be provided on one side of the frame or the other.

* * * * *